US009617802B2

(12) United States Patent
Lastra

(10) Patent No.: US 9,617,802 B2
(45) Date of Patent: Apr. 11, 2017

(54) EXPANDABLE TOOL HAVING HELICAL GEOMETRY

(71) Applicant: Saudi Arabian Oil Company, Dhahran (SA)

(72) Inventor: Rafael Adolfo Lastra, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 463 days.

(21) Appl. No.: 14/025,250

(22) Filed: Sep. 12, 2013

(65) Prior Publication Data

US 2015/0068764 A1 Mar. 12, 2015

(51) Int. Cl.

| | |
|---|---|
| ***E21B 17/20*** | (2006.01) |
| ***E21B 23/01*** | (2006.01) |
| ***E21B 29/10*** | (2006.01) |
| ***E21B 43/10*** | (2006.01) |
| *E04C 3/00* | (2006.01) |
| *E04C 3/04* | (2006.01) |

(52) U.S. Cl.

CPC ..... *E21B 17/20* (2013.01); *E21B 23/01* (2013.01); *E21B 29/10* (2013.01); *E21B 43/103* (2013.01); *E04C 3/005* (2013.01); *E04C 2003/0447* (2013.01)

(58) Field of Classification Search

CPC ..... E21B 23/01; E21B 33/128; E21B 43/10; E21B 43/103; E21B 43/105

See application file for complete search history.

(56) References Cited

U.S. PATENT DOCUMENTS

| | | | | |
|---|---|---|---|---|
| 341,327 | A | 5/1886 | Fay | |
| 2,143,072 | A | 1/1939 | Johnson | |
| 3,314,479 | A * | 4/1967 | McCullough | E21B 23/065 166/135 |
| 4,488,595 | A * | 12/1984 | Akkerman | E21B 23/01 166/134 |
| 4,501,327 | A | 2/1985 | Retz | |
| 4,589,447 | A | 5/1986 | Kane et al. | |
| 5,040,283 | A | 8/1991 | Pelgrom | |

(Continued)

FOREIGN PATENT DOCUMENTS

| | | |
|---|---|---|
| AT | 27764 B | 3/1907 |
| EP | 0265341 A2 | 4/1988 |

(Continued)

OTHER PUBLICATIONS

PCT International Search Report and the Written Opinion of the International Searching Authority dated Oct. 8, 2015; International Application No. PCT/US2014/055150; International Filing Date: Sep. 11, 2014.

*Primary Examiner* — Jennifer H Gay

(74) *Attorney, Agent, or Firm* — Bracewell LLP; Constance Gall Rhebergen

(57) ABSTRACT

An expandable downhole tool for use in an oil well, including a flexible member rolled into a helix and comprising first and second lateral edges on opposing lateral ends of the member. The flexible member is selectively changeable between a compressed configuration wherein the transverse cross-section of the flexible member has a first diameter, and an expanded configuration wherein the transverse cross-section of the flexible member has a second diameter, the second diameter larger than the first diameter.

16 Claims, 7 Drawing Sheets

(56) References Cited

U.S. PATENT DOCUMENTS

| | | | | |
|---|---|---|---|---|
| 5,186,215 | A * | 2/1993 | Gilleland | F16L 55/163 138/98 |
| 5,209,600 | A | 5/1993 | Koster | |
| 5,340,626 | A | 8/1994 | Head | |
| 5,901,789 | A * | 5/1999 | Donnelly | E21B 43/04 166/207 |
| 6,012,522 | A * | 1/2000 | Donnelly | E21B 43/04 166/207 |
| 6,250,385 | B1 * | 6/2001 | Montaron | E21B 43/086 166/207 |
| 6,296,054 | B1 | 10/2001 | Kunz et al. | |
| 6,412,565 | B1 * | 7/2002 | Castano-Mears | E21B 43/086 166/230 |
| 6,637,092 | B1 | 10/2003 | Menzel et al. | |
| 6,675,901 | B2 * | 1/2004 | Johnson | E21B 7/20 138/129 |
| 6,679,334 | B2 | 1/2004 | Johnson et al. | |
| 6,775,894 | B2 | 8/2004 | Hardin | |
| 7,428,928 | B2 | 9/2008 | Cho et al. | |
| 7,647,977 | B2 | 1/2010 | Hall et al. | |
| 7,905,295 | B2 | 3/2011 | Mack | |
| 8,800,650 | B2 * | 8/2014 | Spray | E21B 17/00 166/207 |
| 2011/0049872 | A1 * | 3/2011 | Spray | E21B 43/106 285/330 |
| 2012/0261116 | A1 | 10/2012 | Xu | |

FOREIGN PATENT DOCUMENTS

| | | | |
|---|---|---|---|
| EP | 0522828 | A1 | 1/1993 |
| EP | 1242714 | B1 | 9/2002 |
| EP | 1719873 | A1 | 11/2006 |
| GB | 2326896 | A | 1/1999 |
| WO | 9956000 | A1 | 11/1999 |
| WO | 0146551 | A1 | 6/2001 |
| WO | 2011001189 | A1 | 1/2011 |

* cited by examiner

FIG. 1A
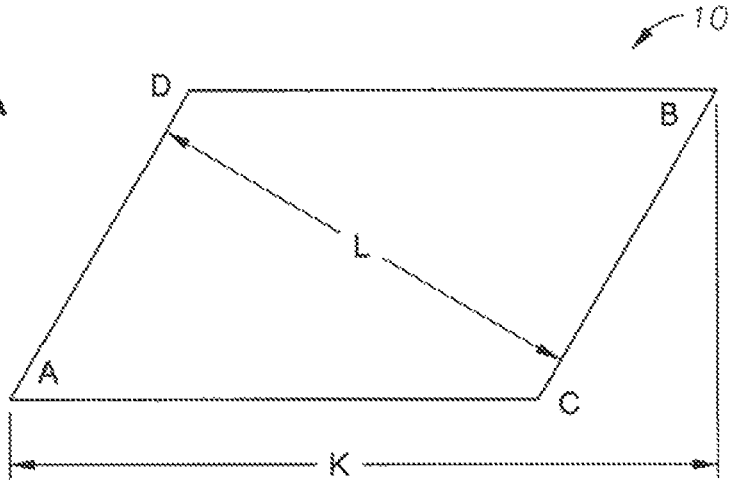
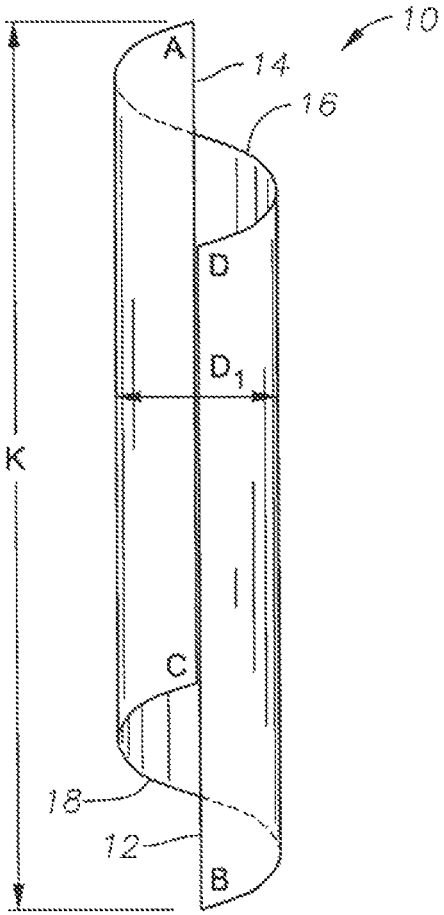
FIG. 1B
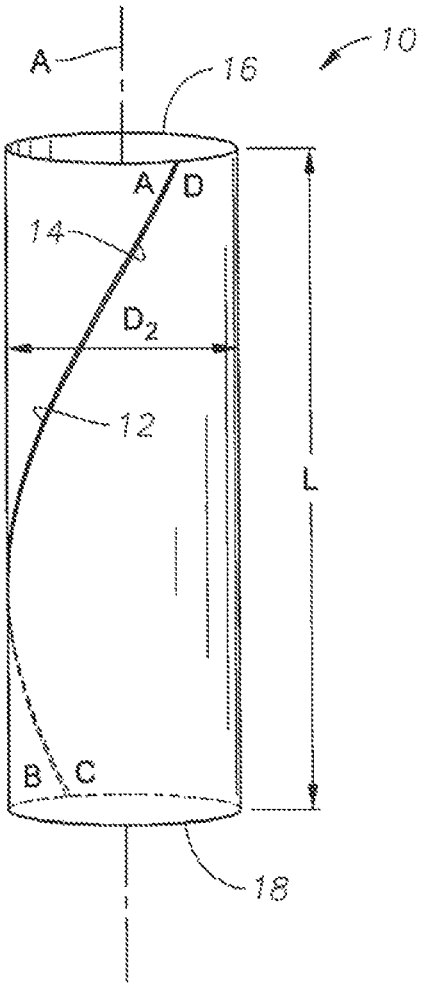
FIG. 1C

EXPANDABLE TOOL HAVING HELICAL GEOMETRY

BACKGROUND OF THE INVENTION

1. Field of the Invention

The present technology relates to oil and gas production. In particular, the present technology relates to expandable tools for use in an oil well.

2. Description of the Related Art

Expandable tools can be useful in drilling and producing oil and gas wells. Typically an expandable tool is one that has a diameter small enough to pass down the bore hole to a predetermined location, and then can expand to have a larger diameter downhole. One example of known expandable tools includes an anchor, which can be inserted into a wellbore attached to a downhole tool. Once the anchor is in position, it can expand into gripping contact with the surfaces of the well bore, thereby fixing the downhole tool in place. Another example includes expandable packers, which can be inserted into a well and then expanded to seal against wellbore surfaces, thereby providing hydraulic isolation between zones in the well bore.

SUMMARY OF THE INVENTION

The present technology provides an expandable downhole tool for use in an oil well, including a flexible member rolled into a helix and comprising first and second lateral edges on opposing lateral ends of the member, the flexible member selectively changeable between a compressed configuration wherein the transverse cross-section of the flexible member has a first diameter, an expanded configuration wherein the transverse cross-section of the flexible member has a second diameter, the second diameter larger than the first diameter.

In some embodiments, the expandable downhole tool can further include at plurality of radial support members attached to the flexible member to maintain the shape of the flexible member, the radial support members positioned at intervals around the inner circumference of the flexible member. In addition, although not required, the tool can also have an elongate member, and a sleeve surrounding the elongate member and axially slideable relative thereto, the radial support members pivotally attached to the sleeve so that the angle of the radial support members relative to the elongate member can change as the flexible member expands and contracts. A longitudinal support member can be attached to the ends of two or more radial support members adjacent an inside surface of the flexible member, the longitudinal support member having a stiffness to support the flexible member from deformation.

In certain embodiments, the flexible member can be planar when in an unrolled configuration, and can have an outer periphery that defines a parallelogram. The flexible member can include an upper edge, a lower edge, and two lateral edges. The upper edge can extend between upper terminal ends of the lateral edges, and the lower edge can extend between lower terminal ends of the lateral edges. The upper edge and the lower edge can each have substantially the same length.

Some embodiments of the present technology contemplate a tool wherein when in the compressed configuration the flexible member is insertable within the well, and when in the expanded configuration the flexible member expands radially outward and anchors against the well. In addition, the flexible member can have first and second lateral edges, wherein the first and second lateral edges face one another.

The first lateral edge of the flexible member can have a pair of seal flappers, and the second lateral edge of the flexible member can be configured for sealing insertion between the flappers, so that the interface between the lateral edges is sealed.

The tool can further include a system for expanding and contracting the flexible member, the system including an elongated sliding cylinder attached to the second lateral edge of the flexible member, and a hollow flexible stem having a pair of extensions. One of the extensions can extend through, and can be moveable relative to, the sliding cylinder, and the other can be fixedly attached to the flexible member at or adjacent to the first lateral edge thereof. The hollow flexible stem can have circulation ports within the sliding cylinder. The system can further include a piston fixedly attached to the extension of the hollow flexible stem inside the sliding cylinder, the piston sealingly engaged with the inner surface of the sliding cylinder so that fluid cannot pass between the piston and inner walls of the sliding cylinder. In addition, there can also be a hydraulic pump attached to the hollow flexible stem for selectively providing hydraulic fluid to the inside of the sliding cylinder on alternate sides of the piston through the circulation ports. The provision of hydraulic fluid to the inside of the sliding cylinder can drive the piston and hollow flexible stem through the elongated sliding cylinder, thereby causing the lateral edges of the flexible member to slide relative to one another so that the flexible member expands or contracts.

In an alternative embodiment, the tool can include a system for expanding and contracting the flexible member, the system including elongated sliding cylinders attached to the flexible member adjacent the first and second lateral edges thereof. The system can also include a hollow flexible stem having a pair of extensions, one of which extends into, and is moveable relative to, the sliding cylinder of the first lateral edge, and the other which extends into, and is moveable relative to, the sliding cylinder of the second lateral edge. The extensions of the hollow flexible stem can have circulation ports within the sliding cylinders. Pistons can be fixedly attached to the extensions of the hollow flexible stem inside the sliding cylinders, the pistons sealingly engaged with the inner surface of the sliding cylinders so that fluid cannot pass between the pistons and inner walls of the sliding cylinders. A hydraulic pump can be attached to the hollow flexible stem for selectively providing hydraulic fluid to the inside of one of the other sliding cylinders through the circulation ports. The provision of hydraulic fluid to the inside of the sliding cylinders can drive the pistons and hollow flexible stem extensions within the elongated sliding cylinders, thereby causing the lateral edges of the flexible member to slide relative to one another so that the flexible hollow body expands or contracts.

In yet another embodiment, the system can include a flexible member having first and second lateral edges, and further including a system for expanding and contracting the flexible member. The system for expanding and contracting the flexible member can have a toothed rack attached to and extending along the first lateral edge of the flexible member, and a toothed pinion attached to the second lateral edge of the flexible member and positioned so that the teeth of the pinion engage the teeth of the rack. When the pinion is rotated, it can drive the rack so that the first lateral edge slides relative to the second lateral edge, thereby causing the flexible hollow body to expand or contract.

The present technology also provides a method of expanding and contracting a tool within a wellbore. The method includes the steps of wrapping a flexible body in a helical configuration, the flexible body having edges aligned so that when the flexible body is wrapped in a helical configuration, the edges slide relative to one another, thereby causing the pitch of the helical configuration to change and expanding or contracting the flexible body, and inserting the flexible body into a wellbore. In addition, the method can include sliding the edges of the flexible body relative to one another so that the cross-sectional area of the flexible body expands.

In some embodiments, the method can include supporting the flexible body by providing at plurality of radial support members attached to the flexible body to maintain the shape of the flexible body, the radial support members positioned at intervals around the inner circumference of the flexible body. In addition, the method can include providing an elongate member extending through the flexible body when the flexible body is wrapped, the elongate member extending into the wellbore for guiding the flexible body into the wellbore, and slidably attaching the radial support, members to the elongate member so that the shape of the flexible body is maintained relative to the elongate member as the flexible body is inserted into the wellbore. In some embodiments, the flexible body can includes an upper edge, a lower edge, and two lateral edges. The upper edge can extend between upper terminal ends of the lateral edges, and the lower edge can extend between lower terminal ends of the lateral edges, the upper edge and the lower edge each having substantially the same length.

There is also described herein a method of constructing an expandable tool. The method includes providing a flexible member that, when extended into a planar configuration, defines a parallelogram having a top edge, a bottom edge, and lateral side edges, wrapping the flexible member so that the lateral side edges align and the flexible member is in a helical configuration, and adjusting the transverse cross-sectional diameter of the helical configuration by sliding the lateral side edges of the flexible member relative to one another. The upper edge can extend between upper terminal ends of the lateral edges, and the lower edge can extend between lower terminal ends of the lateral edges, the upper edge and the lower edge each having substantially the same length.

BRIEF DESCRIPTION OF THE DRAWINGS

The present technology will be better understood on reading the following detailed description of nonlimiting embodiments thereof, and on examining the accompanying drawings, in which:

FIG. 1A is a plan view of an example of a resilient planar member having a parallelogram-like configuration according to an embodiment of the present technology;

FIG. 1B is a side view of a flexible hollow body in a relatively contracted configuration according to an embodiment of the present technology;

FIG. 1C is a side view of the flexible hollow body of FIG. 1A in an expanded configuration;

DETAILED DESCRIPTION OF THE EXEMPLARY EMBODIMENTS

Figure 2A:
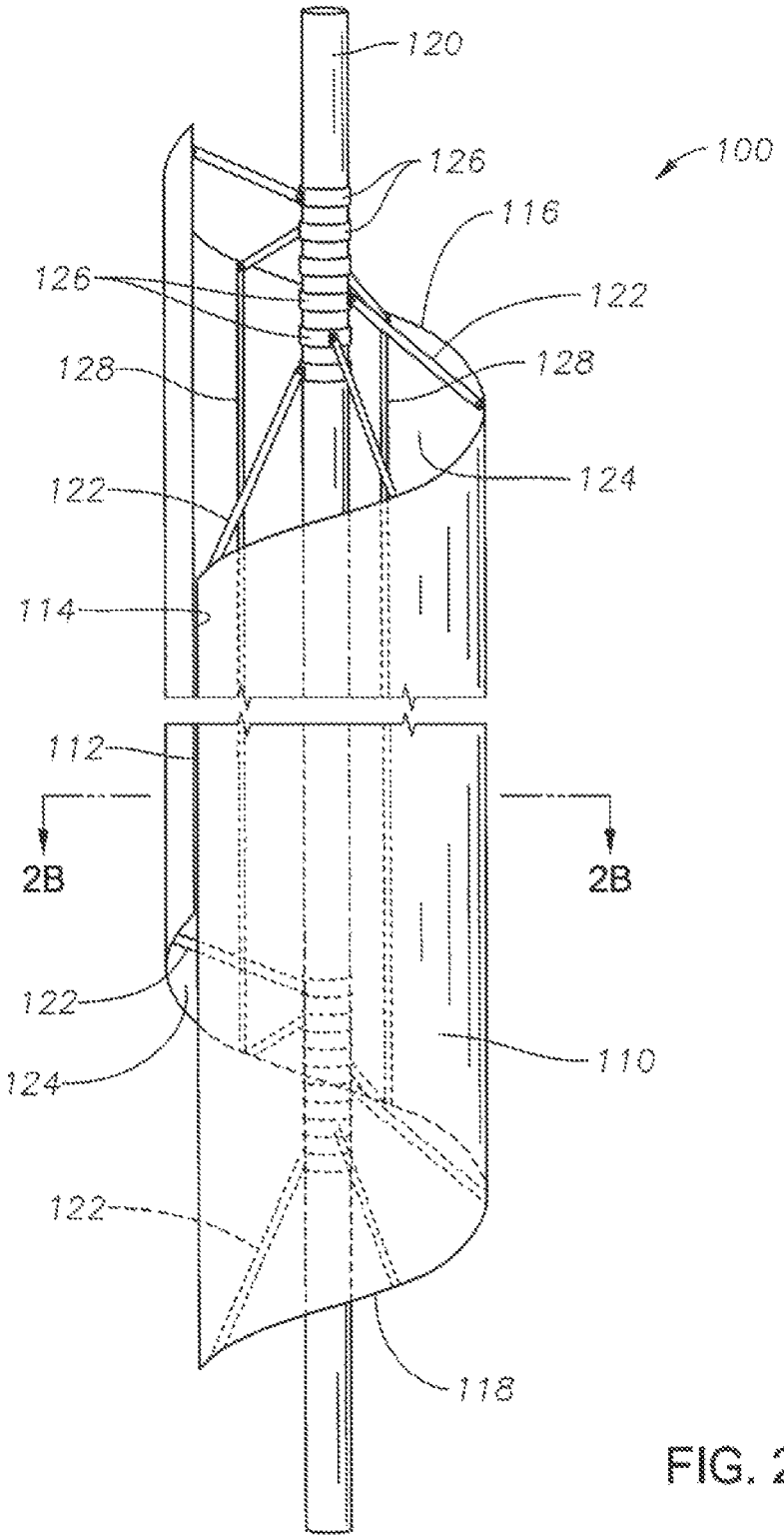
FIG. 2A is a side view of an expandable downhole tool according to an embodiment of the present technology.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the embodiments are not intended to be limited to the specific terms used, and it is to be understood that each specific term includes equivalents that operate in a similar manner to accomplish a similar purpose.

FIG. 1A shows a flexible body 10, such as that to be used in an expandable tool according to the present technology, unrolled into a flat configuration. In FIG. 1A, the flexible body 10 is a planar member having a parallelogram-like shape when flat, and includes corners A, B, C, and D. In addition, the dimensions of the flexible body 10 are defined by distance L as shown, and distance K, which is the horizontal component of the distance from corner A to corner B. The flexible body 10 is made from a resilient, elastic material such as, for example, a polymeric or composite material. Thus, the flexible body 10 can be rolled be into a cylindrical configuration, as shown in FIGS. 1B and 1C.

FIGS. 1B and 1C are side views of the flexible body 10 of an expandable tool according to the present technology in a rolled configuration. When rolled, the flexible body 10 has a first side edge 12 and a second side edge 14 positioned adjacent one another, and a circular cross-section. The axial cross-section of the flexible body 10 increases as the flexible body 10 changes from a relatively contracted configuration (shown in FIG. 1A) to a relatively expanded configuration (shown in FIG. 1B).

As shown in FIG. 11, when the flexible body 10 is in a contracted configuration, top edge 16 and bottom edge 18 extend along helical paths, with top corner A taking up a different axial position than top corner D. Bottom corner C takes on a correspondingly different axial position than bottom corner B. When in the contracted position, the length K of the flexible body is relatively long, and the diameter $D_1$ of the flexible body 10 is relatively small. The flexible body 10 shown in FIG. 1B could be contracted even further by sliding the side edges 12, 14 relative to each other so that corners A and D become even further separated. From the contracted configuration shown in FIG. 1B, the flexible body 10 can expand by sliding side edges 12, 14 relative to one another so that corners A and D move closer together.

As shown in FIG. 1C, when the flexible body 10 is in an expanded configuration, the first and second side edges 12, 14 form a helical shape. In the configuration shown, top edge 16 and bottom edge 18 sit in a plane substantially transverse to the longitudinal axis A of the flexible body 10. In this configuration, top corners A, D are adjacent one another and bottom corners C, B are also adjacent one another. When in the expanded position, the length L of the flexible body 10 is relatively shorter than the length K of the flexible body 10 in its contracted configuration. Similarly, the diameter $D_2$ of the flexible body is relatively larger than the diameter $D_1$ of the flexible body 10 in its contracted configuration. FIG. 1C could be expanded even further by sliding the side edges 12, 14 relative to each other so that corners A and D become even further separated in the opposite direction.

Uses of an expandable tool having a flexible body 10, as shown in FIGS. 1B and 1C, are many. This is because such an expandable tool has the ability to be inserted through tight passages having small diameters, and then, after reaching a location, to radially expand and contact and anchor against side walls of a passage having a larger diameter. Examples of applications where such expandable tools could be of use include packers, fishing tools, screens, bridges, patches, etc. This invention contemplates the use of an expandable tool in any suitable application, including those listed above. In addition, the expandable tool could be deployed to a downhole position using any device currently used to deploy tools and equipment downhole, including, for example, tubing, coiled tubing, wireline, slickline, tractors, autonomous robots, gravity, flow circulation, etc. Although the present invention contemplates deployment using any of these devices, the particular embodiment shown in FIGS. 2A and 2B is of a patch that is deployed by tubing or cable.

Figure 2B:
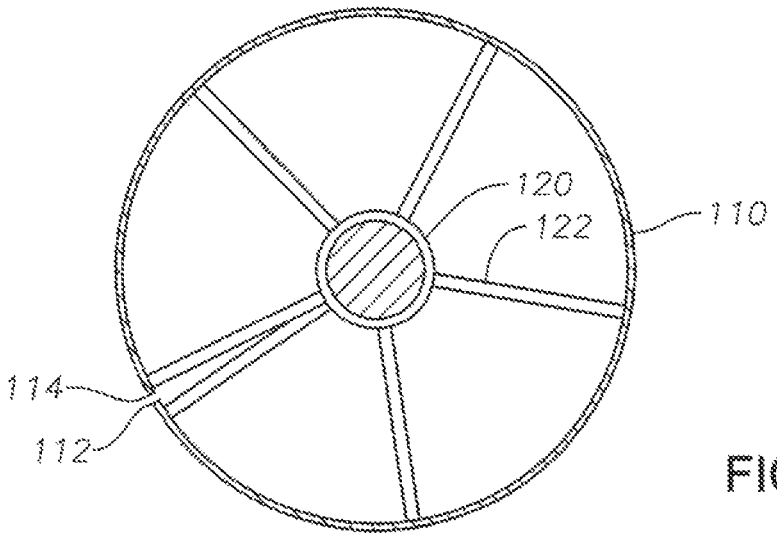
FIG. 2B is an axial section view of the expandable downhole tool of FIG. 2A.

Referring now to FIG. 2A, there is shown an expandable tool 100 that includes a flexible body 110 having a first side edge 112, a second side edge 114, a top edge 116, and a bottom edge 118. The flexible body 10 generally expands and contracts as described above in reference to FIGS. 1A and 1B. In FIG. 2A, the flexible body 110 is shown surrounding an elongate member 120 which can be, for example, a tubular or a cable. The elongate member 120 is used to deploy the flexible body 110 to a predetermined location in a wellbore. Radial support arms 122 extend from the elongate member 120 to an inner surface 124 of the flexible body 110 and help to maintain a constant set off distance between the elongate member 120 and the flexible body 110 substantially along an axial length of the flexible body 110. Radial support arms 122 also support the flexible body 110 against deformation. In the example shown, radial support arms 122 are attached to sleeves 126 that at least partially surround the elongate member 120. The radial support arms 122 are pivotable relative to the sleeves 126, the elongate member 120, and the inner surface 124 of the flexible body 110, thereby allowing for radial expansion and contraction of the flexible body 110, and the accompanying change in shape and position of the edges and surfaces of the flexible body 110. FIG. 2B is a top view of the expandable tool of FIG. 2A, showing the flexible body 110, including the first side edge 112 and second side edge 114, the elongate member 120, and radial support arms 122.

Figure 3:
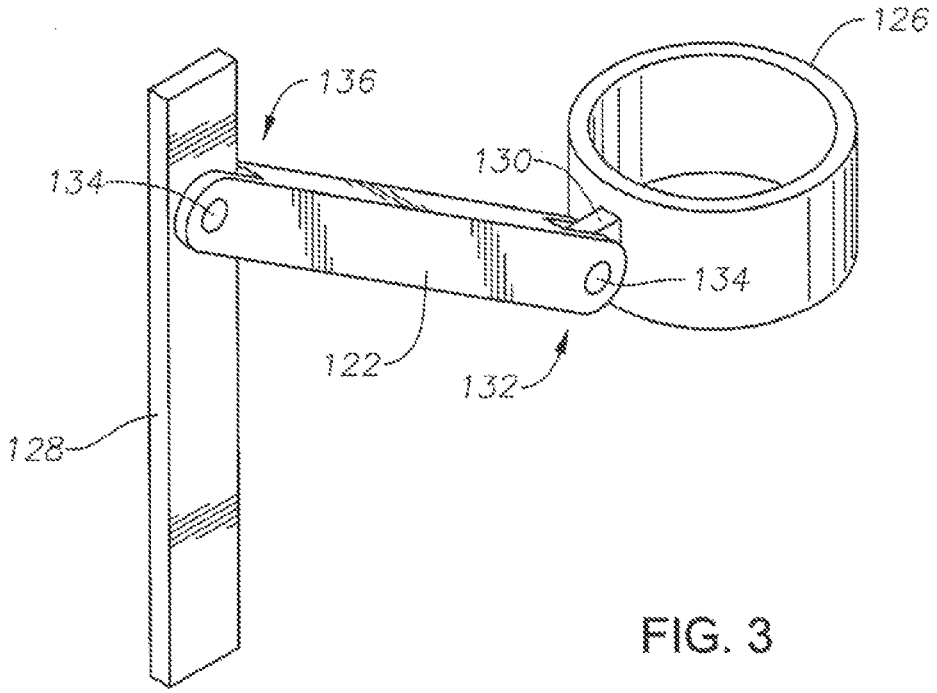
FIG. 3 is a perspective view of an example of a radial support member, sleeve, and longitudinal support member for use with the tool shown in FIGS. 2A and 2B.

FIG. 3 shows an enlarged perspective view of a radial support arm 122, sleeve 126, and a longitudinal support member 128. As shown, each sleeve 126 is configured to surround the surround an axial portion of elongated member 120 (shown in FIGS. 2A and 2B), and to freely rotate circumferentially there around. In some embodiments, the sleeve 126 can only partially surround the elongated member 120. Each radial support arm 122 is pivotally attached to a sleeve 126. Such pivotal attachment can be by any appropriate means, such as, for example, by providing a sleeve tab 130 attached to or formed integrally with the sleeve 126. Sleeve tab 130 projects radially outward from the sleeve 126. The end of the radial support arm 122 can then be attached to the sleeve tab 130 at a support arm end 132 with a fastener 134, which can be, for example, a bolt or a rivet.

The end of radial support arm 122 distal from tab 130 is shown pivotally attached at a support member end 136 to the longitudinal support member 128. Such attachment can likewise be accomplished with a fastener 134, which can be, for example, a bolt or a rivet. The ability of the sleeve 126 to freely rotate around the elongated member 120, and of the radial support arm 122 to pivot relative to the sleeve 126 and the longitudinal support member 128, is beneficial because it allows adjustment of the radial support arm 122 as the flexible body 110 expands and contracts. The longitudinal support member 128 is attached at a distal end (not shown) in similar fashion to another radial support arm located further along the flexible body 10 toward the bottom edge 118; where the other radial support arm couples to a sleeve that circumscribes elongate member 120. The longitudinal support member 128 provides additional structural support to the flexible body 110 in the areas between radial support arms 122.

Figure 4:
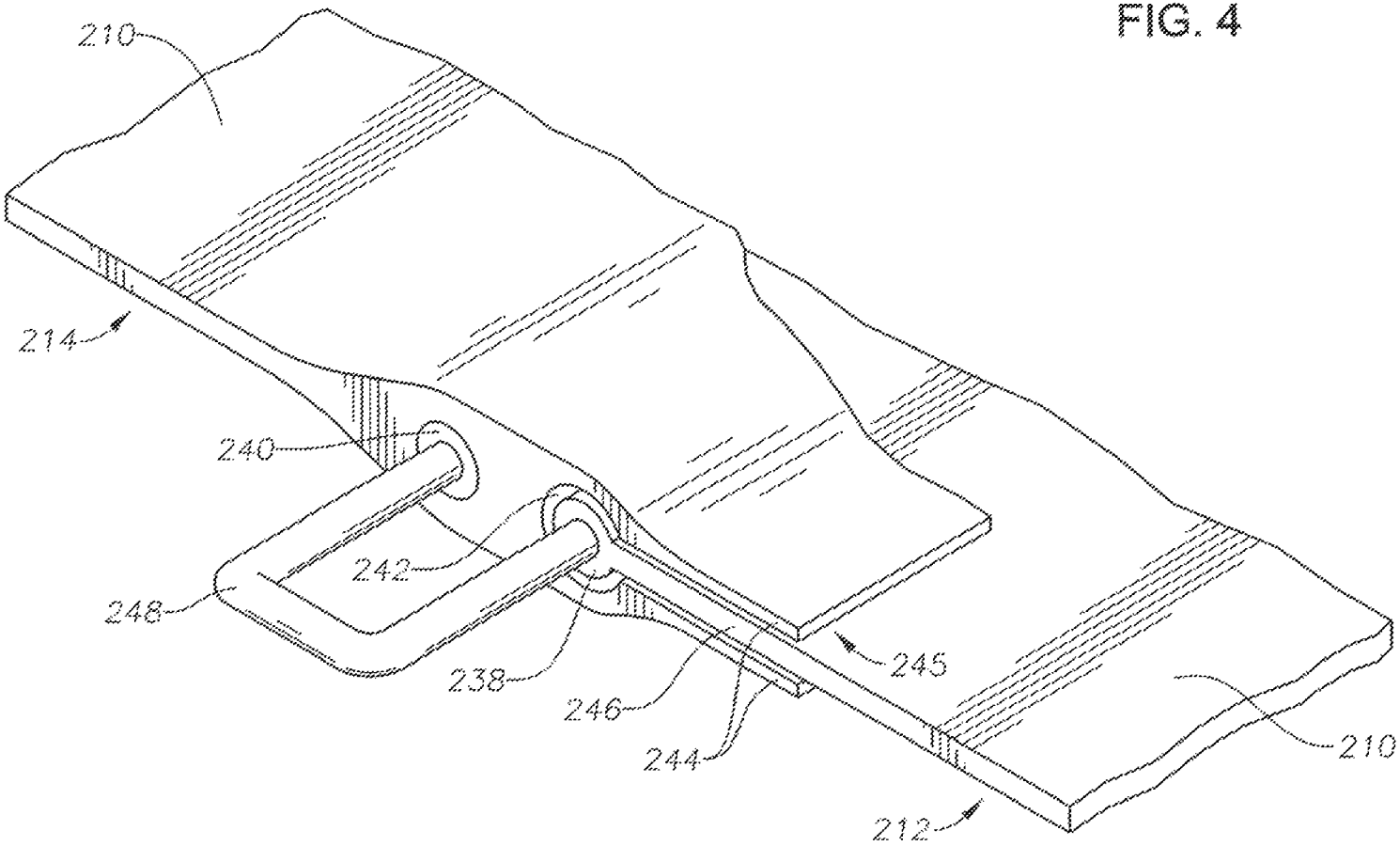
FIG. 4 is a partial cross-sectional perspective view of an interface between first and second edges of the flexible hollow body.

Referring to FIG. 4, there is shown an enlarged sectional view of an alternate embodiment of a body 210 having first and second side edges 212, 214 according to one possible embodiment of the present technology. First side edge 212 includes a sliding cylinder 238 (also shown in FIGS. 5A and 6A) that extends substantially along the length of the first side edge 212. The second side edge 214 includes a fixed cylinder 240, a cylindrical recess 242, and a pair of flappers 244. A slot 245 is defined between flappers 244 that extends into the terminal end of the second side edge 214 and along its length. The fixed cylinder 240 is fixed relative to the second side edge 214. In practice, the sliding cylinder 238 of the first side edge 212 is received into the cylindrical recess 242 of the second side edge 214. The flappers 244 extend beyond the sliding cylinder 238 and overlap an edge portion 246 of the flexible body 210 adjacent the first side edge 212. In some embodiments, the flappers 244 form a seal with the edge portion 246 of the flexible body 210 so that the interface between the first and second side edges 212, 214 is sealed. Alternatively, other types of seals between the first and second side edges 212, 214 can be used. For example, sliding seals can be used, such as zip lock type seals. As the first and second edges 212, 214 move relative to one another, as described above, the sliding cylinder 238 freely slides within the cylindrical recess 242.

An elongate tubular flexible stem 248 is shown connected to the first and second side edges 212, 214, and having parallel portions extending at least partially through the sliding cylinder 238 and the fixed cylinder 240. One purpose of the flexible stem 248 can be to provide a means for expanding and contracting the flexible body 210 as described herein below. The places where the flexible stem 248 enters and exits the sliding cylinder 238, and in some cases the fixed cylinder 240, are sealed so that areas 249 (shown in FIGS. 5B and 6B) between the flexible stem 248 and the inner walls of the cylinders are closed chambers.

Figure 5A:
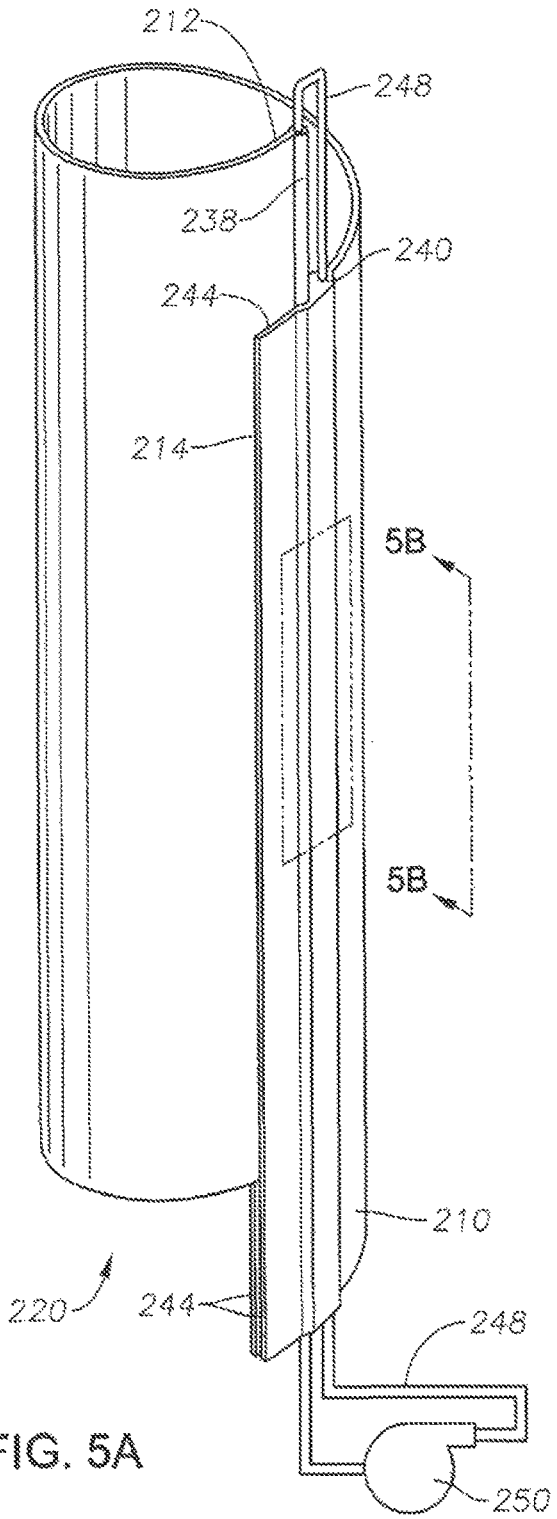
FIG. 5A is a side schematic view of an example of a system for driving the expansion and contraction of the expandable downhole tool of FIGS. 2A and 2B.
Figure 5B:
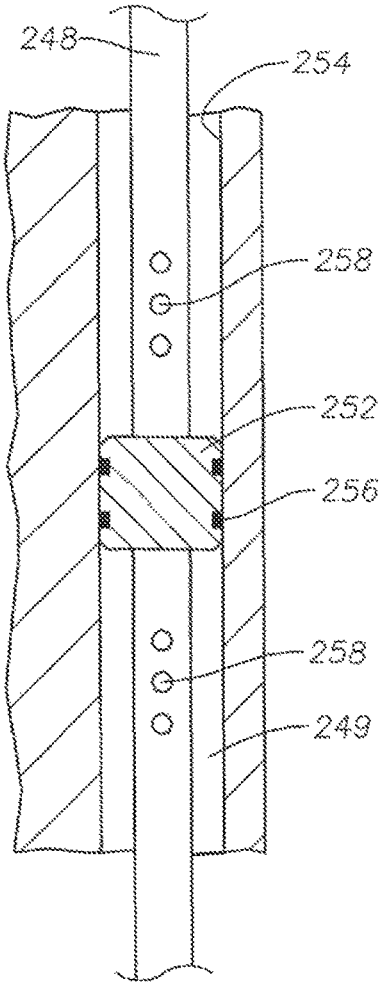
FIG. 5B is an enlarged partial cross-sectional view of the area identified as area 5B in FIG. 5A.

FIGS. 5A and 5B show one possible system and method for expanding and contracting the flexible tool 220. The system includes a hydraulic pump 250 attached to the flexible stem 248 that extends through the sliding cylinder 238 and the fixed cylinder 240. The flexible stem is fixedly attached to the fixed cylinder 240. The flexible stem 248 is hollow and hydraulic fluid flows through the stem 248. A radial cutaway view of the portion of the flexible stem 248 inside the sliding cylinder 238 is shown in FIG. 5B. As shown, a piston 252 mounts onto a portion of the flexible stem 248 within the sliding cylinder 238. The piston 252 is configured to sealingly engage inner walls 254 of a bore extending through the sliding cylinder 238. If necessary, piston seals 256 can be provided between the piston 252 and the inner walls 254. Fluid ports 258 are strategically located in the flexible stem 248 on both sides of piston 252, and selectively allow hydraulic fluid to pass from the inside of the flexible stem 248 to the area 249 inside of the sliding cylinder 238.

Thus configured, the pump 250 can selectively provide hydraulic fluid to the area 249 inside the sliding cylinder 238 on either side of the piston 252. The added fluid pressure within the sliding cylinder 238 causes the sliding cylinder 238 to move relative to the flexible stem 248. Because the flexible stem 248 is fixedly attached to the fixed cylinder 240, such movement of the sliding cylinder 238 causes the first and second side edges 212, 214 of the flexible body 210 to move relative to one another. As described above in conjunction with FIGS. 1A and 1B, such relative motion of the first and second side edges 212, 214 causes the flexible body 210 to expand or contract.

Figure 6A:
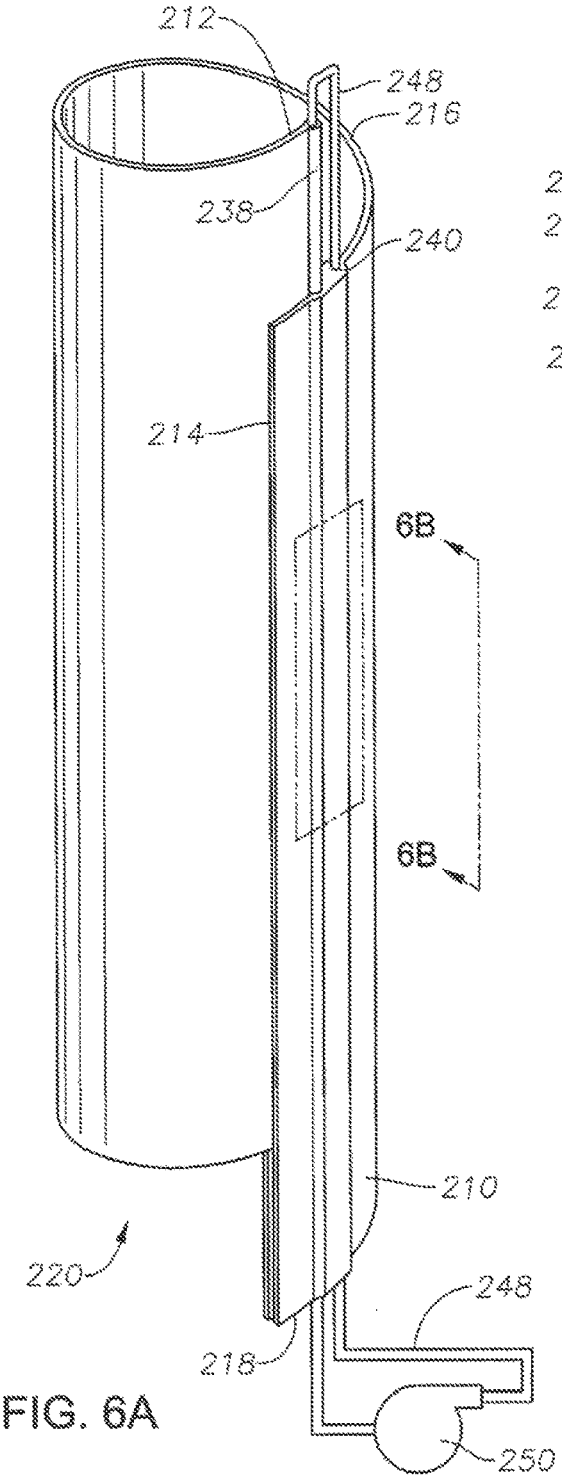
FIG. 6A is a side schematic view of an alternate system for driving the expansion and contraction of the expandable downhole tool of FIGS. 2A and 2B.
Figure 6B:
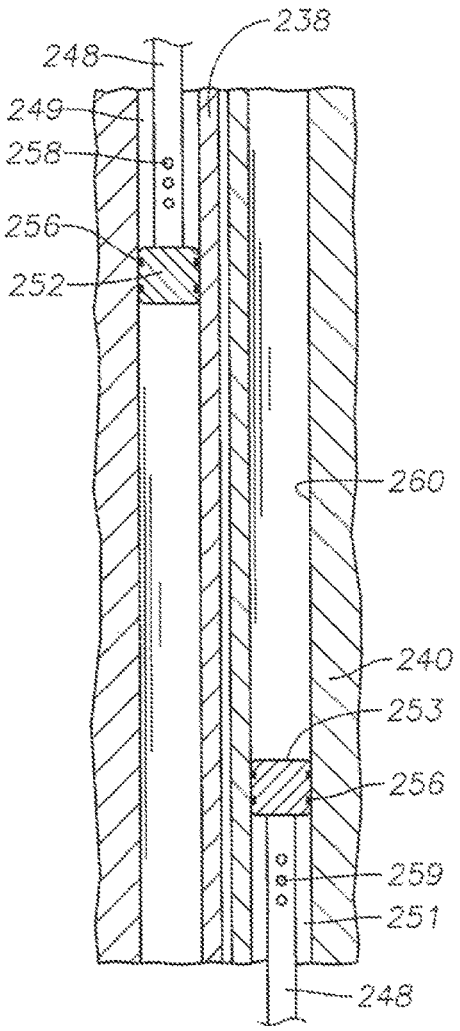
FIG. 6B is an enlarged partial cross-sectional view of the area identified as area 6B in FIG. 6A.

FIGS. 6A and 6B show another possible system and method for expanding and contracting the flexible tool 220. The system includes a hydraulic pump 250 attached to the flexible stem 248. In this embodiment, the flexible stem 248 extends only partially through the sliding cylinder 238 and the fixed cylinder 240, as shown in FIG. 6B. Moreover, the flexible stem 248 is not affixed to the fixed cylinder 240, but is free to slide in and out of the fixed cylinder 240. The flexible stem 248 is hollow and hydraulic fluid pressurized by pump 250 flows through the stem 248. A side cutaway view of the portion of the flexible stem 248 inside the sliding cylinder 238 and fixed cylinder 240 is shown in FIG. 6B. As shown, terminal ends of the flexible stem 248, inside the sliding cylinder 238 and the fixed cylinder 240, each include a piston 252, 253. Piston 252 is configured to sealingly engage inner walls 254 of a bore extending through the sliding cylinder 238, and piston 253 is configured to sealingly engage inner walls 260 of a bore extending through the fixed cylinder 240. If necessary, piston seals 256 can be provided between the pistons 252, 253 and the inner walls 254, 260. Fluid ports 258, 259 are located in the flexible stem 248 and allow hydraulic fluid to pass from the inside of the flexible stem 248 to the areas 249, 251 inside of the sliding cylinder 238 and the fixed cylinder 260.

Thus configured, the pump 250 can selectively provide hydraulic fluid to the areas 249, 251 inside the sliding cylinder 238 and/or the fixed cylinder 240. The added fluid pressure within the cylinders 238, 240 causes them to move relative to the flexible stem 248. Because the pressurized area 251 of the fixed cylinder 240 is located adjacent the top edge 216 of the flexible body 210, and the pressurized area 249 of the sliding cylinder 238 is located adjacent a bottom edge 218 of the flexible body 210, the movement of the first and second side edges 212, 214 will be in opposite axial directions. As described above in conjunction with FIGS. 1A and 1B, such relative motion of the first and second side edges 212, 214 causes the flexible body 210 to radially expand or contract. One advantage to the use of hydraulic power in both the sliding cylinder 238 and the fixed cylinder 240 is that it is possible to effect twice the relative displacement between the side edges 212, 214, and twice the sliding power if needed.

Figure 7:
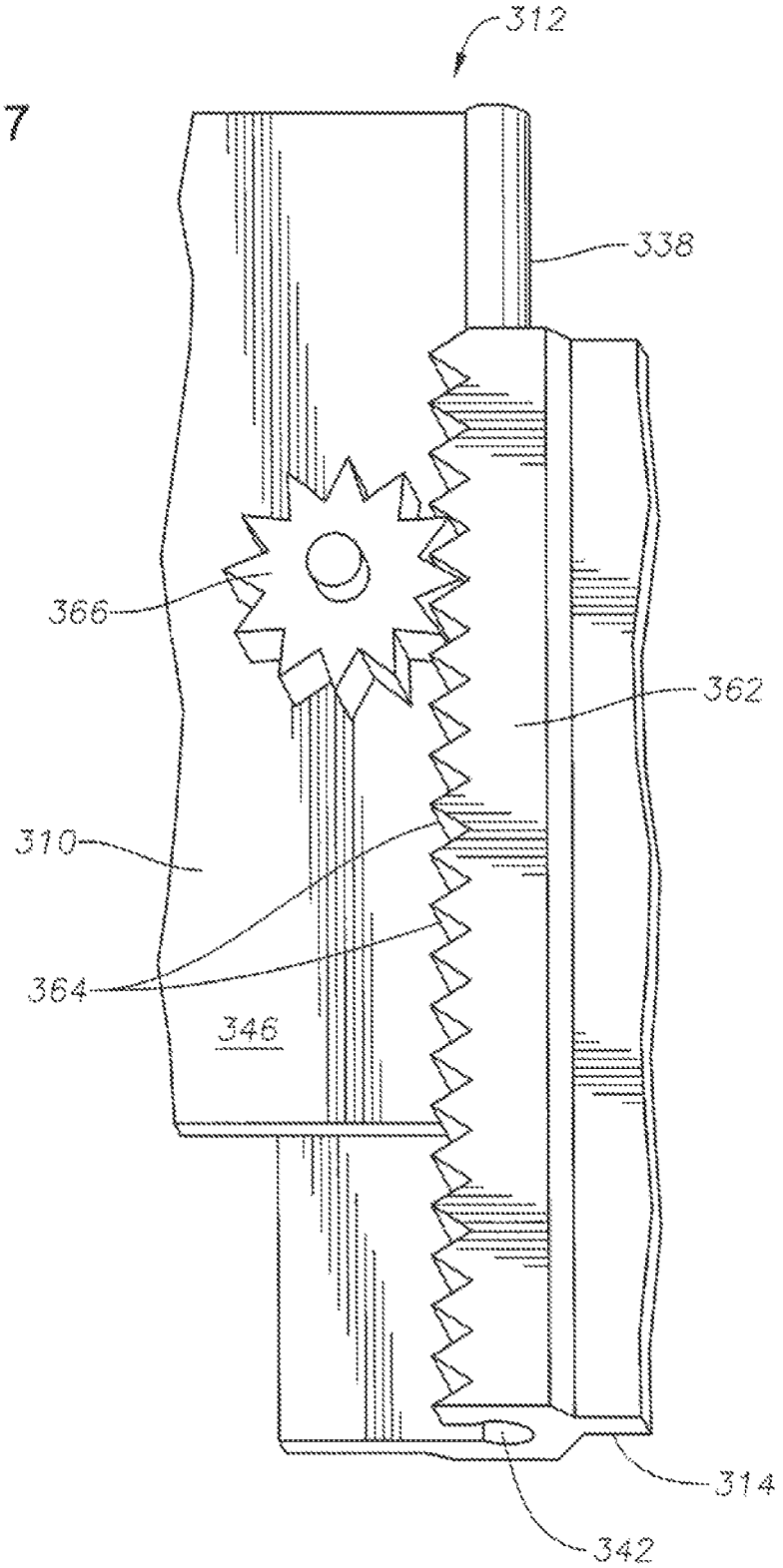
FIG. 7 is a partial cross-section side view of an example system for driving the expansion and contraction of the expandable downhole tool of FIGS. 2A and 2B.

FIG. 7 shows yet another embodiment of the present technology, including an alternate mechanism for moving the first side edge 312 relative to the second side edge 314 of the flexible body 310. In this embodiment, one of the flappers 244 (shown in FIG. 4) is replaced by a rack 362 having a plurality of teeth 364. The rack 362 is positioned adjacent a cylindrical recess 342 extending axially through edge 312 and configured to receive a sliding cylinder 338. A toothed pinion 366 is attached to an edge portion 346 of the flexible body 310 adjacent the first side edge 312 and the sliding cylinder 338. The toothed pinion 366 is positioned so that its teeth engage the teeth 364 of the rack 262. As the pinion 366 rotates, the teeth of the pinion 366 drive the rack 362, and thus the second side edge 314 forward or backward relative to the pinion 366 and the first side edge 312. The pinion 366 can be powered by any appropriate means. For example, the pinion 366 can be driven by a hydraulic or electric motor (not shown). As described above, such relative motion of the first and second side edges 312, 314 causes the flexible body 310 to expand or contract.

The expandable tool of the present technology can be used in many different oilfield operations. For example, the expandable can be used with packers, anchors, expandable logging tools, etc. One preferred embodiment includes use of the expandable tool as a patch. Such an expandable patch can be useful, for example, in wells having fluid leaking into the wellbore. The expandable patch can be inserted into the well until it reaches the part of the well bore where fluid is leaking in. Then, the patch can be expanded into contact with the surfaces of the wellbore to stop the ingress of fluid. The length of the expandable tool can be as long as needed in a particular application. In addition multiple expandable tools can be inserted in series with the ends overlapping to provide coverage to longer or uneven areas.

In addition, any suitable material can be used to develop tools according to the above description, including, for example, metal, plastics, elastomers, etc. Furthermore, the ratio of expansion and contraction is a function of the length and width of the flexible body. Thus, there is no limit to the ratio of expansion of the tool. The more expansion is needed, the longer the flexible body needs to be. In practical terms, the limit of expansion will be the maximum length of the tool used to deploy the expandable tool.

Although the technology herein has been described with reference to particular embodiments, it is to be understood that these embodiments are merely illustrative of the principles and applications of the present technology. It is therefore to be understood that numerous modifications can be made to the illustrative embodiments and that other arrangements can be devised without departing from the spirit and scope of the present technology as defined by the appended claims.

What is claimed is:

1. An expandable downhole tool for use in an oil well, comprising:

a flexible member rolled into a helix and having a longitudinal axis, the flexible member comprising first and second lateral edges on opposing lateral ends of the member, the flexible member selectively changeable between a compressed configuration wherein the transverse cross-section of the flexible member has a first diameter; and an expanded configuration wherein the transverse cross-section of the flexible member has a second diameter, the second diameter larger than the first diameter;

a pitch of the first lateral edge and a pitch of the second lateral edge changing relative to the longitudinal axis as the flexible member changes from the compressed configuration to the expanded configuration.

2. The tool of claim 1, further comprising:

at plurality of radial support members attached to the flexible member to maintain the shape of the flexible member, the radial support members positioned at intervals around the inner circumference of the flexible member.

3. The tool of claim 2, further comprising:

an elongate member; and a sleeve surrounding the elongate member and axially slideable relative thereto, the radial support members pivotally attached to the sleeve so that the angle of the radial support members relative to the elongate member can change as the flexible member expands and contracts.

4. The tool of claim 3, further comprising:

a longitudinal support member attached to the ends of two or more radial support members adjacent an inside surface of the flexible member, the longitudinal support member having a stiffness to support the flexible member from deformation.

5. The tool of claim 2, wherein the flexible member comprises an upper edge, a lower edge, and wherein the upper edge extends between upper terminal ends of the lateral edges and the lower edge extends between lower terminal ends of the lateral edges, the upper edge and the lower edge each having substantially the same length.

6. The tool of claim 1, wherein the flexible member is planar when in an unrolled configuration and has an outer periphery that defines a parallelogram.

7. The tool of claim 1, wherein when in the compressed configuration the flexible member is insertable within the well, and when in the expanded configuration the flexible member expands radially outward and anchors against the well.

8. The tool of claim 1, wherein the first and second lateral edges face one another, and wherein the first lateral edge of the flexible member has a pair of seal flappers, and the second lateral edge of the flexible member is configured for sealing insertion between the flappers, so that the interface between the lateral edges is sealed.

9. The tool of claim 8, further comprising a system for expanding and contracting the flexible member, the system comprising:

an elongated sliding cylinder attached to the second lateral edge of the flexible member;

a hollow flexible stem having a pair of extensions, one of which extends through, and is moveable relative to, the sliding cylinder, and the other which fixedly attaches to the flexible member at or adjacent to the first lateral edge thereof, the hollow flexible stem having circulation ports within the sliding cylinder;

a piston fixedly attached to the extension of the hollow flexible stem inside the sliding cylinder, the piston sealingly engaged with the inner surface of the sliding cylinder so that fluid cannot pass between the piston and inner walls of the sliding cylinder; and a hydraulic pump attached to the hollow flexible stem for selectively providing hydraulic fluid to the inside of the sliding cylinder on alternate sides of the piston through the circulation ports;

wherein the provision of hydraulic fluid to the inside of the sliding cylinder drives the piston and hollow flexible stem through the elongated sliding cylinder, thereby causing the lateral edges of the flexible member to slide relative to one another so that the flexible member expands or contracts.

10. The tool of claim 8, further comprising a system for expanding and contracting the flexible member, the system comprising:

elongated sliding cylinders attached to the flexible member adjacent the first and second lateral edges thereof;

a hollow flexible stem having a pair of extensions, one of which extends into, and is moveable relative to, the sliding cylinder of the first lateral edge, and the other which extends into, and is moveable relative to, the sliding cylinder of the second lateral edge, the extensions of the hollow flexible stem having circulation ports within the sliding cylinders;

pistons fixedly attached to the extensions of the hollow flexible stem inside the sliding cylinders, the pistons sealingly engaged with the inner surface of the sliding cylinders so that fluid cannot pass between the pistons and inner walls of the sliding cylinders; and a hydraulic pump attached to the hollow flexible stem for selectively providing hydraulic fluid to the inside of one of the other sliding cylinders through the circulation ports;

wherein the provision of hydraulic fluid to the inside of the sliding cylinders drives the pistons and hollow flexible stem extensions within the elongated sliding cylinders, thereby causing the lateral edges of the flexible member to slide relative to one another so that the flexible hollow body expands or contracts.

11. The tool of claim 1, further comprising a system for expanding and contracting the flexible member comprising:

a toothed rack attached to and extending along the first lateral edge of the flexible member; and a toothed pinion attached to the second lateral edge of the flexible member and positioned so that the teeth of the pinion engage the teeth of the rack;

wherein when the pinion is rotated, it drives the rack so that the first lateral edge slides relative to the second lateral edge, thereby causing the flexible hollow body to expand or contract.

12. A method of expanding and contracting a tool within a wellbore, the method comprising the steps of:

wrapping a flexible body in a helical configuration, the flexible body having lateral edges aligned so that when the flexible body is wrapped in a helical configuration, the lateral edges slide relative to one another, thereby causing a pitch of each of the lateral edges of the helical configuration to change while expanding or contracting the flexible body;

inserting the flexible body into a wellbore;

sliding the lateral edges of the flexible body relative to one another so that the cross-sectional area of the flexible body expands.

13. The method of claim 12, further comprising:

supporting the flexible body by providing at plurality of radial support members attached to the flexible body to maintain the shape of the flexible body, the radial support members positioned at intervals around the inner circumference of the flexible body.

14. The method of claim 13, further comprising:

providing an elongate member extending through the flexible body when the flexible body is wrapped, the elongate member extending into the wellbore for guiding the flexible body into the wellbore.

15. The method of claim 14, further comprising slidably attaching the radial support members to the elongate member so that the shape of the flexible body is maintained relative to the elongate member as the flexible body is inserted into the wellbore.

16. The method of claim 12, wherein the flexible body comprises an upper edge, a lower edge, and wherein the upper edge extends between upper terminal ends of the lateral edges and the lower edge extends between lower terminal ends of the lateral edges, the upper edge and the lower edge each having substantially the same length.

* * * * *